US006390391B1

(12) United States Patent
Ulin

(10) Patent No.: US 6,390,391 B1
(45) Date of Patent: May 21, 2002

(54) SPRINKLER APPARATUS

(76) Inventor: Joyce Ulin, 1321 NE. Beacon Ave., Lee Summit, MO (US) 64086

( * ) Notice: Subject to any disclaimer, the term of this patent is extended or adjusted under 35 U.S.C. 154(b) by 0 days.

(21) Appl. No.: 09/922,148

(22) Filed: Aug. 3, 2001

(51) Int. Cl.[7] ..... B05B 1/14

(52) U.S. Cl. ..... 239/548; 239/203; 239/273; 239/275; 239/279; 239/204; 239/556; 239/566; 239/722; 239/DIG. 1; 239/16; D23/213; D23/214

(58) Field of Search ..... 39/16, 17, 200, 39/203, 204, 206, 210, 246, 247, 257, 263, 273, 275, 80, 279, 280.5, 548, 556, 558, 560, 561, 565, 566, 722, 723, DIG. 1; D23/213, 214

(56) References Cited

U.S. PATENT DOCUMENTS 188,628 A * 3/1877 Heacock ..... 239/280
564,412 A * 7/1896 Rath ..... 239/276
1,084,094 A * 1/1914 Loosen ..... 239/391
D48,137 S * 11/1915 Thompson
1,854,613 A 4/1932 Ishikawa
2,290,258 A * 7/1942 Svet ..... 239/204
2,566,856 A * 9/1951 Rose ..... 239/101
3,337,134 A * 8/1967 Bond ..... 239/19
3,506,196 A 4/1970 Ramsey
3,854,665 A 12/1974 Rodgers
4,205,785 A 6/1980 Stanley
5,505,380 A 4/1996 Jun
D374,914 S 10/1996 Wang

* cited by examiner

*Primary Examiner*—Robin O. Evans

(57) ABSTRACT

A sprinkler apparatus for transferring water from a supply hose to a ground surface. The sprinkler apparatus includes a conical-shaped main body member with a plurality of apertures around the outer surface for watering close to the sprinkler, and a retractable spray nozzle on the top for covering the area surrounding the sprinkler.

6 Claims, 2 Drawing Sheets

SPRINKLER APPARATUS

BACKGROUND OF THE INVENTION

1. Field of the Invention

The present invention relates to sprinklers and more particularly pertains to a new sprinkler apparatus for transferring water from a supply hose to a ground surface.

2. Description of the Prior Art

The use of sprinklers is known in the prior art. More specifically, sprinklers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,005,785; 3,854,665; 1,854,613; 3,506,196; 5,505,380; and U.S. Pat. No. Des. 374,914.

While these devices fulfill their respective, particular objectives and requirements, the aforementioned patents do not disclose a new sprinkler apparatus. The inventive device includes a conical-shaped main body member with a plurality of apertures around the outer surface for watering close to the sprinkler, and a retractable spray nozzle on the top for covering the area surrounding the sprinkler.

In these respects, the sprinkler apparatus according to the present invention substantially departs from the conventional concepts and designs of the prior art, and in so doing provides an apparatus primarily developed for the purpose of transferring water from a supply hose to a ground surface.

SUMMARY OF THE INVENTION

In view of the foregoing disadvantages inherent in the known types of sprinklers now present in the prior art, the present invention provides a new sprinkler apparatus construction wherein the same can be utilized for transferring water from a supply hose to a ground surface.

The general purpose of the present invention, which will be described subsequently in greater detail, is to provide a new sprinkler apparatus apparatus and method which has many of the advantages of the sprinklers mentioned heretofore and many novel features that result in a new sprinkler apparatus which is not anticipated, rendered obvious, suggested, or even implied by any of the prior art sprinklers, either alone or in any combination thereof.

To attain this, the present invention generally comprises a conical-shaped main body member with a plurality of apertures around the outer surface for watering close to the sprinkler, and a retractable spray nozzle on the top for covering the area surrounding the sprinkler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sprinkler apparatus apparatus and method which has many of the advantages of the sprinklers mentioned heretofore and many novel features that result in a new sprinkler apparatus which is not anticipated, rendered obvious, suggested, or even implied by any of the prior art sprinklers, either alone or in any combination thereof.

It is another object of the present invention to provide a new sprinkler apparatus which may be easily and efficiently manufactured and marketed.

It is a further object of the present invention to provide a new sprinkler apparatus which is of a durable and reliable construction.

An even further object of the present invention is to provide a new sprinkler apparatus which is susceptible of a low cost of manufacture with regard to both materials and labor, and which accordingly is then susceptible of low prices of sale to the consuming public, thereby making such sprinkler apparatus economically available to the buying public.

Still yet another object of the present invention is to provide a new sprinkler apparatus which provides in the apparatuses and methods of the prior art some of the advantages thereof, while simultaneously overcoming some of the disadvantages normally associated therewith.

Still another object of the present invention is to provide a new sprinkler apparatus for transferring water from a supply hose to a ground surface.

Yet another object of the present invention is to provide a new sprinkler apparatus which includes a conical-shaped main body member with a plurality of apertures around the outer surface for watering close to the sprinkler, and a retractable spray nozzle on the top for covering the area surrounding the sprinkler.

Still yet another object of the present invention is to provide a new sprinkler apparatus that effectively covers the area directly adjacent to the sprinkler, along with the outer areas.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
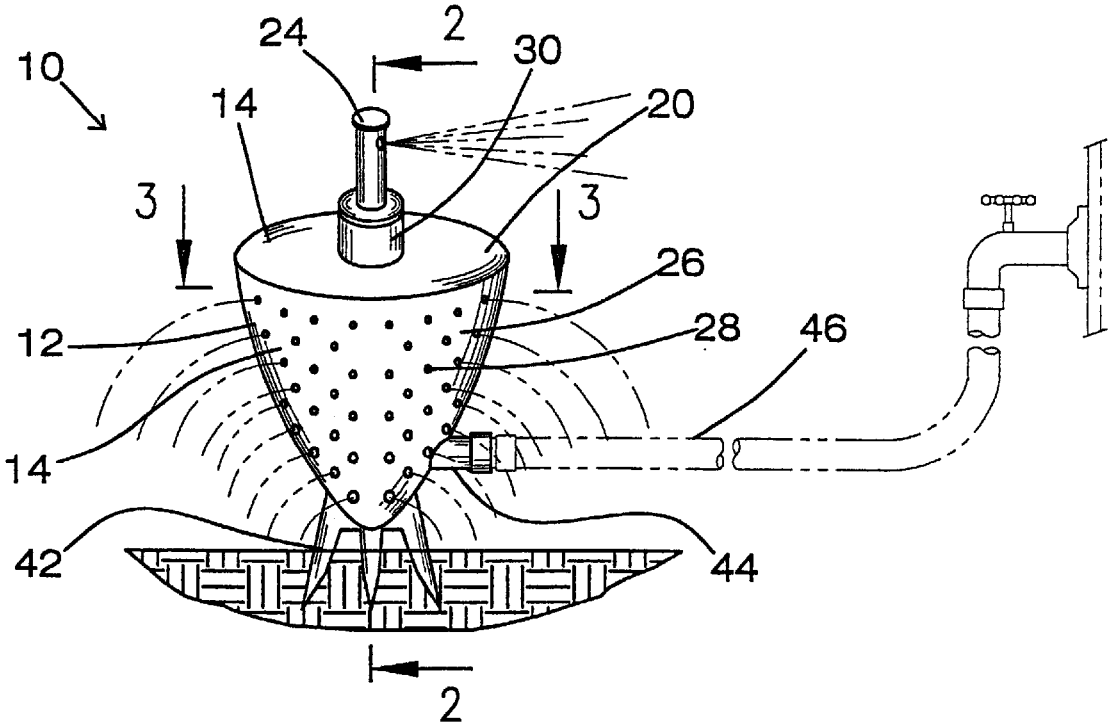
FIG. 1 is a schematic perspective view of a new sprinkler apparatus according to the present invention.
Figure 2:
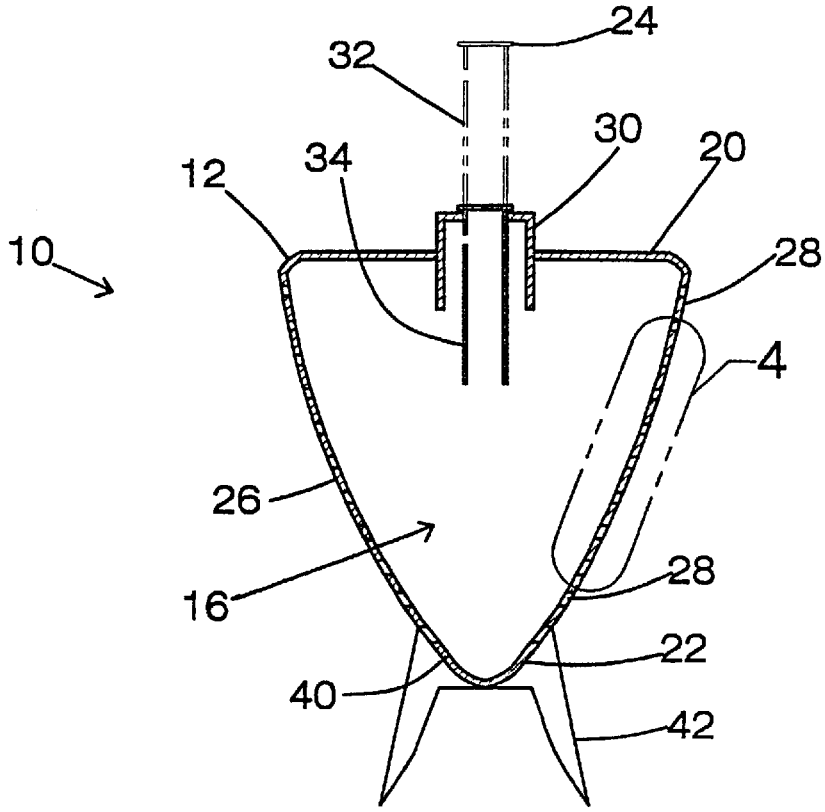
FIG. 2 is a schematic side cross-sectional view of the present invention.
Figure 3:
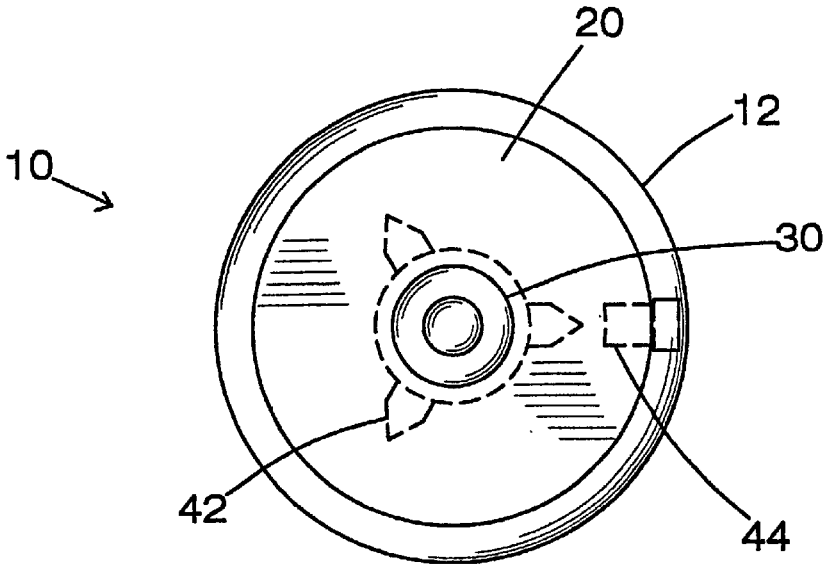
FIG. 3 is a schematic top view of the present invention.
Figure 4:
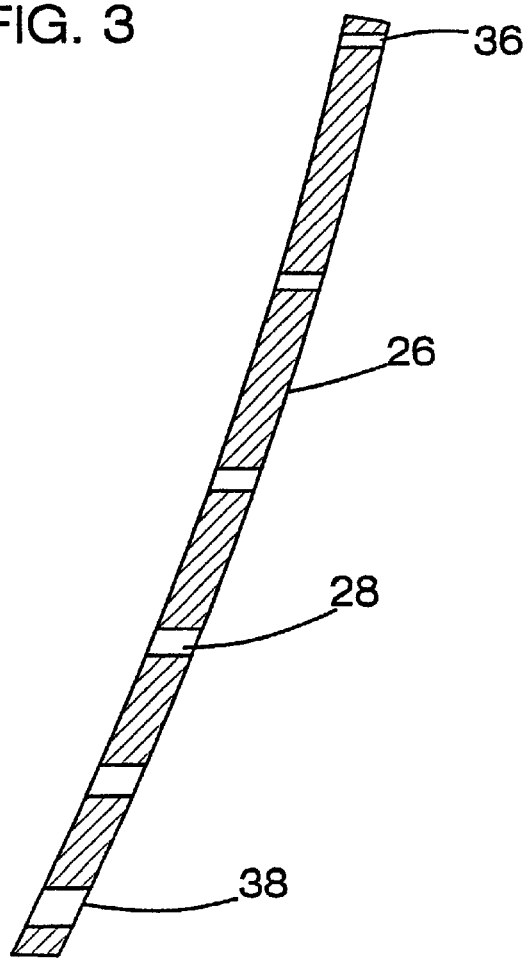
FIG. 4 is a schematic sectional view of the exterior surface containing the various sized apertures of the present invention.

With reference now to the drawings, and in particular to FIGS. 1 through 4 thereof, a new sprinkler apparatus embodying the principles and concepts of the present invention and generally designated by the reference numeral 10 will be described.

As best illustrated in FIGS. 1 through 4, the sprinkler apparatus 10 generally comprises a main body member 12. The main body member 12 has exterior surfaces 14. The exterior surfaces 14 define an interior space 16. The interior space 16 is designed for holding water under pressure.

The main body member 12 has a generally conical shaped cross-section. The main body member 12 has a top end 20 and a bottom end 22. The top end 20 of the main body member 12 includes a spray nozzle 24 such that the spray nozzle 24 is designed for distributing water under pressure over a wide circumferential area.

An outer surface 26 of the main body member 12 has a plurality of apertures 28. The apertures 28 are designed for distributing water under pressure to a circumferential area in close proximity to the main body member 12 thereby distributing water to the ground surface that is not covered by the spray nozzle 24.

The top end 20 of the main body member 12 comprises a nozzle housing 30. The nozzle housing 30 is centrally positioned in the top end 20. The nozzle housing 30 comprises the spray nozzle 24.

The spray nozzle 24 is slidably mounted in the nozzle housing 30 such that the spray nozzle 24 extends upwardly to a spray position 32 when the interior space 16 of the main body member 12 is under pressure. The spray nozzle 24 is in a retracted position 34 when the interior space 16 is not under pressure.

The apertures 28 of the outer surface 26 have a small diameter 36 proximate the top end 20 of the main body member 12 and increase in diameter in a linear fashion towards the bottom end 22 of the main body member 12 such that the apertures 28 proximate the bottom end 22 are a large diameter 38. This allows the water under pressure in the interior space 16 to be distributed evenly within the circumferential area in close proximity to the main body member 12 when the interior space 16 is under pressure.

The bottom end 22 of the main body member 12 comprises a crown portion 40. The crown portion 40 has a mounting member 42. The mounting member 42 is fixedly coupled to the crown portion 40 of the main body member 12 such that the mounting member 42 is designed for selectively coupling the main body member 12 to the ground surface.

The main body member 12 includes an inlet port 44. The inlet port 44 is selectively couplable to the supply hose 46 such that the inlet port 44 is designed for receiving water under pressure, thereby filling the interior space 16 with water under pressure allowing the water to be distributed through the spray nozzle 24 and the apertures 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sprinkler apparatus for transferring water from a supply hose to a ground surface, the sprinkler apparatus comprising:

a main body member, said main body member having exterior surfaces, said exterior surfaces defining an interior space, said interior space being adapted for holding water under pressure;

said main body member having a generally conical shaped cross-section, said main body member having a top end and a bottom end, said top end of said main body member including a spray nozzle such that said spray nozzle being adapted for distributing water under pressure over a wide circumferential area; and an outer surface of said main body member having a plurality of apertures, said apertures being adapted for distributing water under pressure to a circumferential area in close proximity to said main body member thereby distributing water to the ground surface which is not covered by said spray nozzle.

2. The sprinkler apparatus as set forth in claim 1, further comprising:

said top end of said main body member comprising a nozzle housing, said nozzle housing being centrally positioned in said top end, said nozzle housing comprising said spray nozzle; and said spray nozzle being slidably mounted in said nozzle housing such that said spray nozzle extends upwardly to a spray position when said interior space of said main body member is under pressure, said spray nozzle is in a retracted position when said interior space is not under pressure.

3. The sprinkler apparatus as set forth in claim 1, further comprising:

said apertures of said outer surface having a small diameter proximate said top end of said main body member and increasing in diameter in a linear fashion towards said bottom end of said main body member such that the water under pressure in said interior space is distributed evenly within the circumferential area in close proximity to said main body member when said interior space is under pressure.

4. The sprinkler apparatus as set forth in claim 1, further comprising:

said bottom end of said main body member comprising a crown portion, said crown portion having a mounting member, said mounting member being fixedly coupled to said crown portion of said main body member such that said mounting member being adapted for selectively coupling said main body member to the ground surface.

5. The sprinkler apparatus as set forth in claim 1, further comprising:

said main body member including an inlet port, said inlet port being selectively couplable to the supply hose such that said inlet port being adapted for receiving water under pressure, thereby filling said interior space with water under pressure allowing the water to be distributed through said spray nozzle and said apertures.

6. A sprinkler apparatus for transferring water from a supply hose to a ground surface, the sprinkler apparatus comprising:

a main body member, said main body member having exterior surfaces, said exterior surfaces defining an interior space, said interior space being adapted for holding water under pressure;

said main body member having a generally conical shaped cross-section, said main body member having a top end and a bottom end, said top end of said main body member including a spray nozzle such that said spray nozzle being adapted for distributing water under pressure over a wide circumferential area;

an outer surface of said main body member having a plurality of apertures, said apertures being adapted for distributing water under pressure to a circumferential area in close proximity to said main body member thereby distributing water to the ground surface which is not covered by said spray nozzle;

said top end of said main body member comprising a nozzle housing, said nozzle housing being centrally positioned in said top end, said nozzle housing comprising said spray nozzle;

said spray nozzle being slidably mounted in said nozzle housing such that said spray nozzle extends upwardly to a spray position when said interior space of said main body member is under pressure, said spray nozzle is in a retracted position when said interior space is not under pressure;

said apertures of said outer surface having a small diameter proximate said top end of said main body member and increasing in diameter in a linear fashion towards said bottom end of said main body member such that the water under pressure in said interior space is distributed evenly within the circumferential area in close proximity to said main body member when said interior space is under pressure;

said bottom end of said main body member comprising a crown portion, said crown portion having a mounting member, said mounting member being fixedly coupled to said crown portion of said main body member such that said mounting member being adapted for selectively coupling said main body member to the ground surface;

said main body member including an inlet port, said inlet port being selectively couplable to the supply hose such that said inlet port being adapted for receiving water under pressure, thereby filling said interior space with water under pressure allowing the water to be distributed through said spray nozzle and said apertures.

* * * * *